United States Patent [19]

Moomaw

[11] Patent Number: 4,867,728

[45] Date of Patent: Sep. 19, 1989

[54] TOY TOP LAUNCHER

[75] Inventor: David E. Moomaw, East Aurora, N.Y.

[73] Assignee: The Quaker Oats Company, Chicago, Ill.

[21] Appl. No.: 255,368

[22] Filed: Oct. 11, 1988

[51] Int. Cl.[4] ..... A63H 1/06; A63H 1/18; A63H 29/00

[52] U.S. Cl. ..... 446/259; 446/257; 446/429

[58] Field of Search ..... 446/259, 256, 257, 258, 446/260, 262, 263, 264, 265, 266, 429, 430

[56] References Cited

U.S. PATENT DOCUMENTS

| | | | |
|---|---|---|---|
| 102,244 | 4/1870 | Franke | 446/256 |
| 387,761 | 8/1888 | Briggs | 446/260 X |
| 739,506 | 9/1903 | Purdum | 446/260 |
| 846,047 | 3/1907 | Newman | 446/260 |
| 945,484 | 1/1910 | Anderson | 446/260 |
| 1,644,182 | 10/1927 | Dailey | 446/256 |
| 2,619,769 | 12/1952 | Gallaher | 446/257 X |
| 2,633,664 | 4/1953 | Neilson | 446/257 |
| 3,018,584 | 1/1962 | Passariello | 446/259 |
| 3,269,055 | 8/1966 | Gordon | 446/259 X |
| 3,449,859 | 6/1969 | Neilson | 446/259 X |

FOREIGN PATENT DOCUMENTS

| | | | |
|---|---|---|---|
| 77111 | 9/1894 | Fed. Rep. of Germany | 446/260 |
| 136078 | of 1902 | United Kingdom | 446/259 |

OTHER PUBLICATIONS

Musical Top, "Plastic Toy and Novelty Corp. Catalog", 3-66, p. 259.

*Primary Examiner*—Robert A. Hafer
*Assistant Examiner*—D. Neal Muir
*Attorney, Agent, or Firm*—Cumpston & Shaw

[57] ABSTRACT

A toy top launcher simulating a space shuttle is disclosed for launching a rotating top having a circular enlarged end and a gear adjacent the opposite end onto a flat surface. The top launcher has a chamber for supporting the enlarged ends of a plurality of tops is a row. A discharge station is provided for discharging the leading top from the chamber to a starting launching position on a launch pad. The launch pad has a pair of spaced elongated edges defining an open-ended elongated slot having a gear track along one edge thereof. A launch slider is mounted for reciprocal movement on the launch pad, and in one direction of movement engages the top and urges the gear thereof into meshing engagement with the gear rack. Further movement of the slider imparts rotation and forward motion to the top, expelling the top from the open-end of the slot.

14 Claims, 4 Drawing Sheets

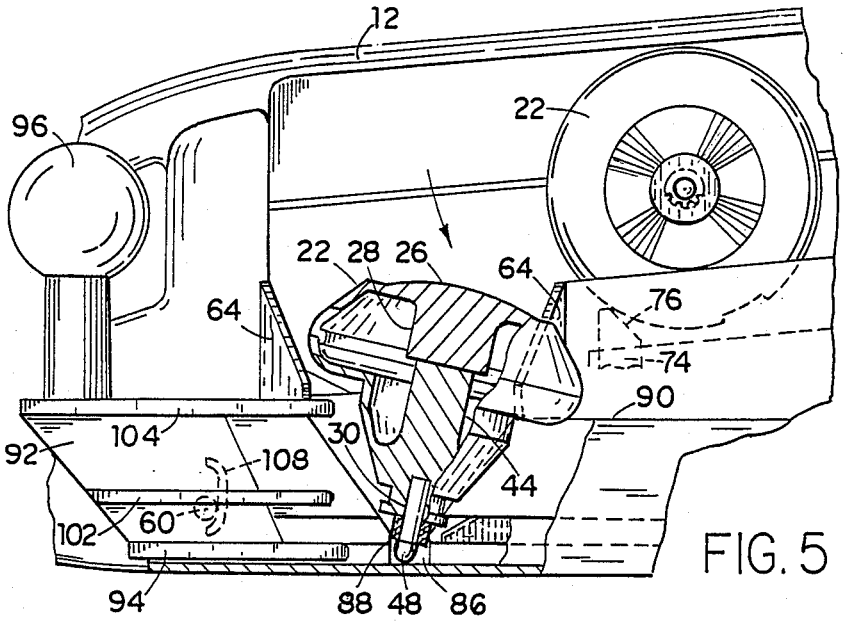
FIG. 5
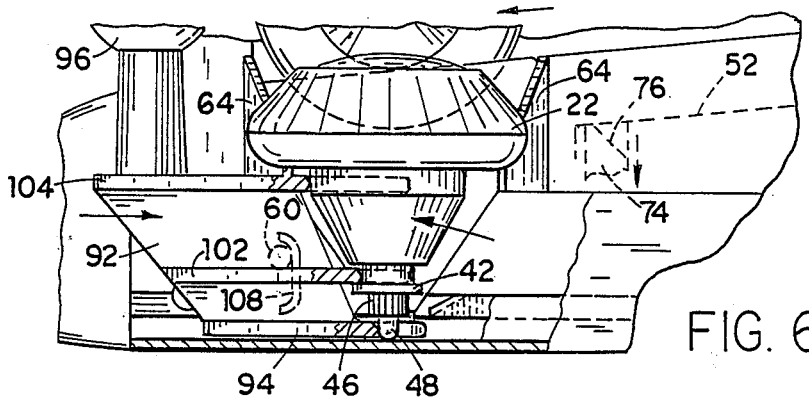
FIG. 6
FIG. 7
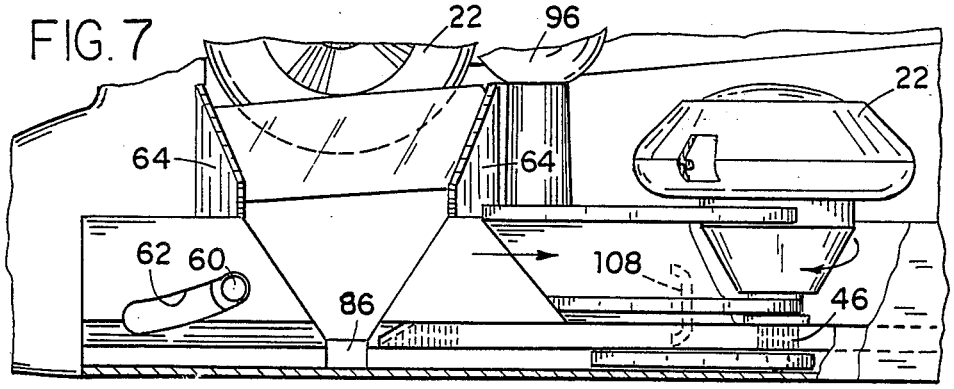

TOY TOP LAUNCHER

BACKGROUND OF THE INVENTION:

1. Field of the Invention

The present invention relates generally to toy tops, and more particularly to a toy top launcher for imparting rotation to a top and launching the top from the launcher.

2. Description of the Prior Art

Children have been entertained for years by the action of toy spinning tops. One such top has a reciprocally movable vertical plunger having a spiral thread for imparting rotation to a thread follower on the body of the top. Accordingly, reciprocal movement of the plunger imparts rotation or a spinning motion to the top. Other tops are known in which a cord is wrapped around an axially extending portion of the top, and is adapted when the cord is pulled from the top to impart spinning movement thereto. Other tops are known having an axial upper post, which is gripped between the thumb and two index fingers, and a spinning movement imparted thereto by twisting the thumb and fingers.

Although the known toy tops are enjoyable, the need still exists for more entertaining, interesting and educational toys and means for imparting spinning movement or motion to the tops.

SUMMARY OF THE INVENTION

An object of this invention is accomplished by providing a toy top launcher for a top having a circular enlarged end and a gear adjacent the opposite end thereof comprising:

a launch pad having a pair of spaced elongated edges defining an open-ended elongated slot;

a gear rack along one edge of the slot;

support means on the launch pad for supporting the top in a substantially vertical starting launching position with the gear in the slot; and launch means on the launch pad for engaging the top and urging the gear thereof along the gear rack for imparting rotation and forward motion to the top and expelling the top from the open-end of the slot.

Another object of the invention is to provide a toy top launcher with holding means for holding a plurality of tops in a row in alignment with one another, and discharge means for discharging the leading top on to the top support means of the launch pad.

A further object of the present invention is to provide the toy top launcher with guide means for guiding the top onto the top support means of the launch pad into the starting launching position.

Still another object of the invention is to provide a toy top launcher in which the top support means comprises a pair of railings engagable by the enlarged end of the top in its starting launching position, and opposed notches are provided in the edges of the elongated slot defining corners for engaging a portion of the top adjacent the gear Still another object of the invention is to provide a toy top launcher wherein the launch means thereof comprises a slider mounted on the launch pad for reciprocal movement. The slider has a first notch plate for receiving and engaging a rounded peg at one end of the top for moving the slightly inclined top into a vertical position and the gear into toothed engagement with the gear rack. The slider further has a second notched plate spaced from and parallel to the first notched plate for receiving a peripheral recess on the top, and holding the gear thereof into engagement with the gear rack. The slider further has a third notched plate spaced from and parallel to the first and second notched plates for receiving a circular shoulder on the top, whereby the first, second and third notched plates engage and propel the top along the longitudinal slot and out of the open-end thereof.

A further object of the invention is to provide an improved top for use in a toy top launcher comprising:

a circular enlarged end;

an opposite rounded peg; and a gear adjacent the rounded peg.

In a more specific object of the invention, the top has a circular shoulder adjacent the enlarged end, an annular rib adjacent the gear, and a peripheral recess adjacent the annular rib.

Still another object of the invention is to provide a method for launching a rotating top having a circular enlarged end and a gear adjacent the opposite end thereof, from a top launcher of the type described heretofore, comprising the steps of:

orienting the top at a starting launching position with the top in a substantially vertical position and the opposite end of the top and gear in the slot;

propelling the top along the slot by means of a slider causing the gear to engage the gear rack and to move therealong for imparting rotation to the top; and expelling the rotating top out of the open-end of the slot onto a flat support surface for rotation thereon.

In still another object of the invention, the method of launching the rotating top comprises the further steps of:

storing within a chamber a plurality of tops in a row;

discharging the tops from the chamber one at a time; and guiding each top discharged from the chamber to the starting launching position.

BRIEF DESCRIPTION OF THE DRAWINGS

In the detailed description of the invention presented below, reference is made to the accompanying drawings, in which:

FIG. 5 is a segmental side-elevational view of the top launcher showing a discharged top in its inclined position at the starting launching position;

FIG. 6 is a segmental side-elevational view similar to FIG. 5 showing the top in a vertical position upon initial movement of the slider from its starting launching position;

FIG. 7 is a side-elevational view of the slider urging a top and the gear thereof along the gear rack for imparting rotation and forward motion to the top.

DETAILED DESCRIPTION OF THE PREFERRED EMBODIMENT

Because toy tops are well-known, the present description will be directed in particular to elements forming part of, or cooperating directly with, a toy top launcher in accordance with the present invention. It is to be understood that the elements not specifically shown or described may take various forms well-known to those skilled in the art.

Figure 1:
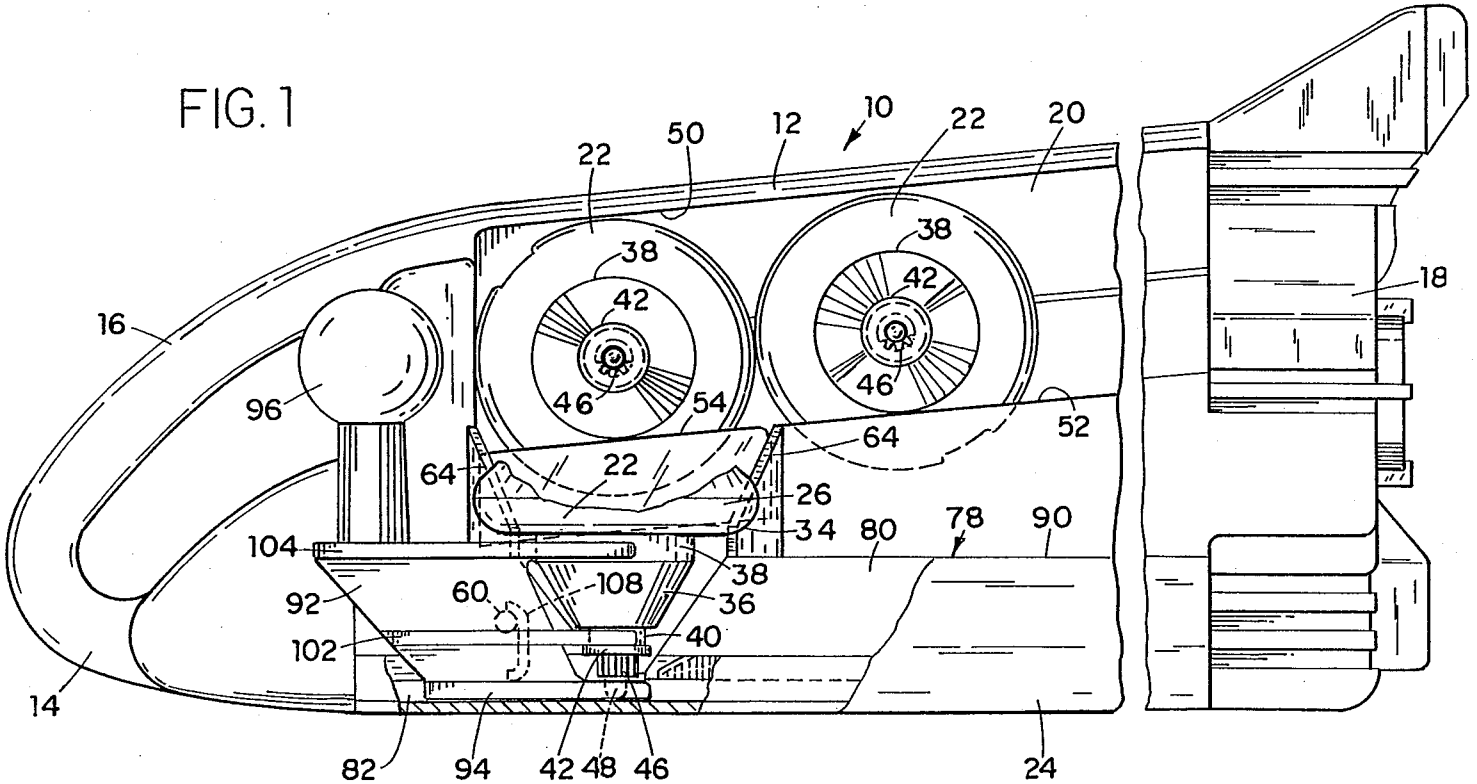
FIG. 1 is a side-elevational view of a toy top launcher in accordance with a preferred embodiment of the invention, with a portion thereof broken away.
Figure 2:
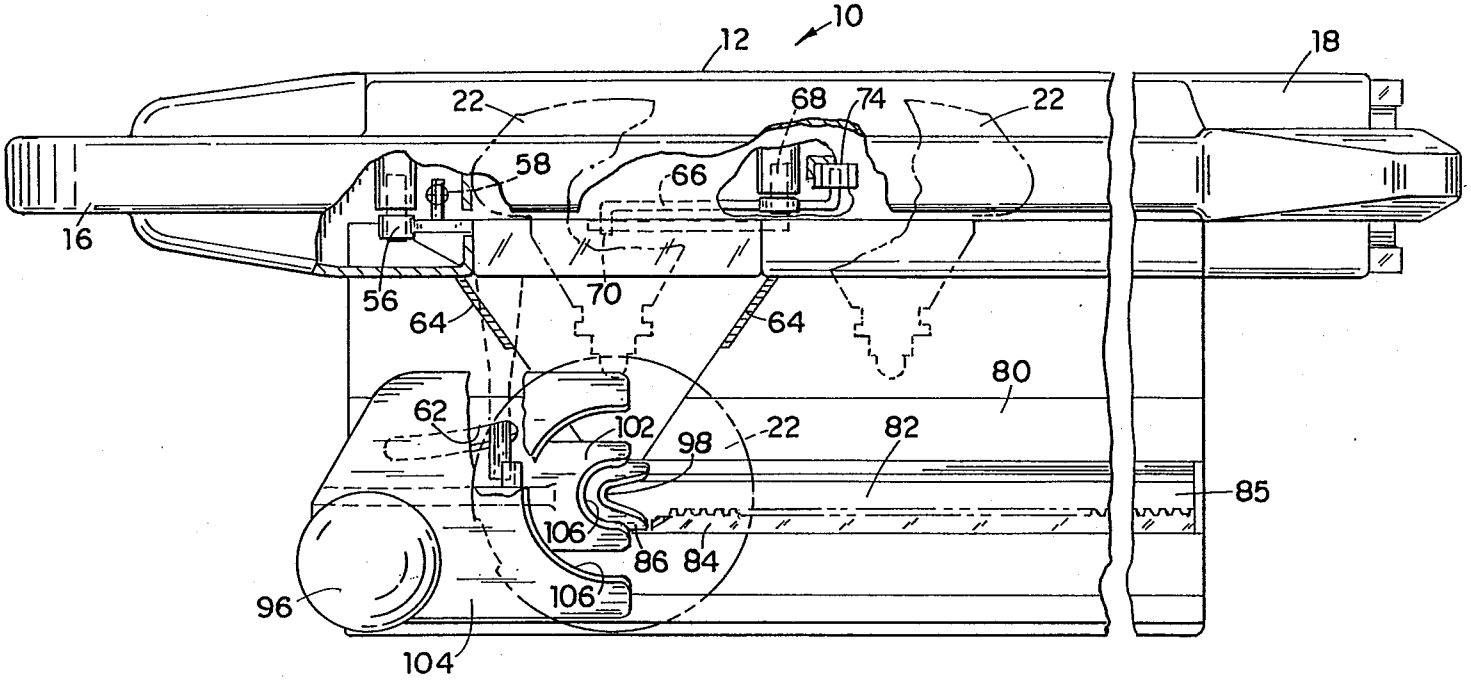
FIG. 2 is a top plan view of the toy top launcher of FIG. 1.
Figure 4:
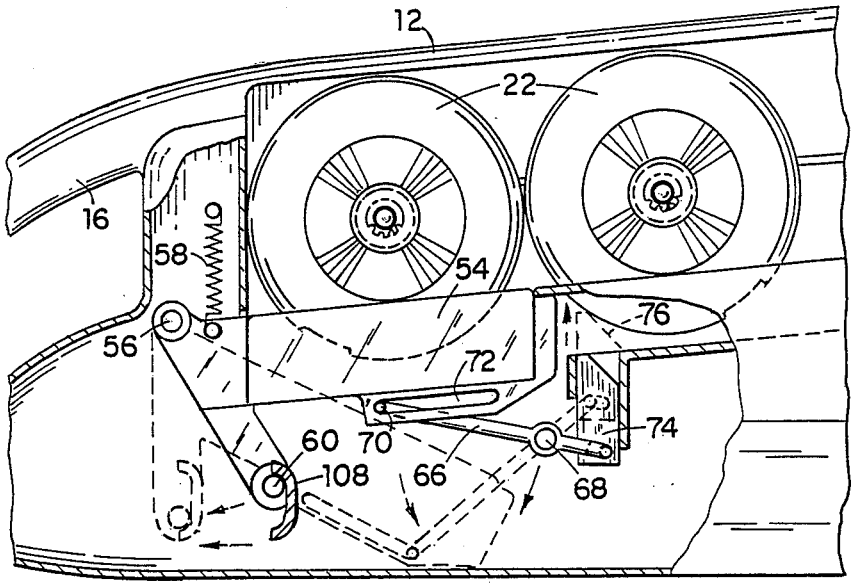
FIG. 4 is a side-elevational view of the discharge means for discharging a top from the chamber onto the launch pad.
Figure 3:
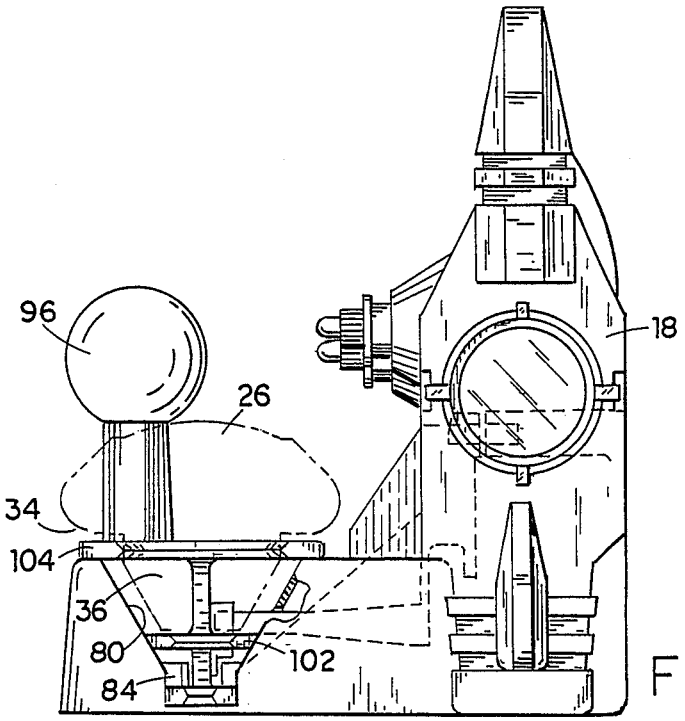
FIG. 3 is a right-end elevational view of the toy top launcher of FIG. 1.

With reference to FIGS. 1–3, a preferred embodiment of the toy top launcher of this invention is disclosed in the form of a toy space shuttle. The top launcher comprises a center body section 12, a front-end portion 14 having a handle 16 by which the top launcher 10 is held onto a flat support surface, and a rear end section 18 having a simulated tail and rocket thereon. The body section 12 has a semi-cylindrical cavity or chamber 20 for supporting a row of tops 22 mounted therein. The body section 12 further supports a laterally extending elongated launch pad 24 for receiving the tops from the chamber, one top at a time, and for imparting spinning motion to the top and expelling the top onto the flat support surface.

Since each of the tops 22 are identical, only one of the tops will be described in detail. The top comprises an upper saucer shaped section 26 having a central boss 28 provided with a depending rod 30. The top 22 further has a lower section 32 having a dish-shaped end portion 34 that mates with the saucer-shaped section 26 to form an enlarged end of the top. Adjacent the dish-shaped end portion 34 is a frusto-conical section 36 having a circular shoulder 38 at one end, and a circular recess 40 at the opposite end adjacent an annular rib 42. The frusto-conical shaped section 36 of the top has a central boss 44 in alignment with the central boss 28 in the upper section 26, and has an axial bore through which the rod 30 extends. The upper and lower top sections 26, 32 are secured together, a gear 46 is secured to the rod 30, and a rounded nylon peg 48 is secured to the outer end of the rod.

The tops 22 are mounted in the launcher chamber 20 by placing the enlarged end of each top into the chamber and pivoting the top upwardly, causing the enlarged end to be forced past an elongated lip 50 on the upper end edge of the chamber 20. In this loaded position, the circular shoulder 38 of each top rests on an inclined ramp 52 formed by the lower edge of the chamber. The inclined ramp causes the tops to slide downwardly towards the front handle end of the launcher.

With reference to FIGS. 1 and 5, discharge means are disclosed for discharging one top 22 at a time from the chamber 20 onto the launch pad 24. The discharge means comprises a ramp portion 54 for supporting the circular shoulder 38 on the leading top. The ramp portion 54 is mounted for pivotal movement about a pivot pin 56, and is biased by a spring 58 encircling the pin into a top holding position. A lower portion of the pivotal ramp portion 54 is provided with a laterally extending post 60, that extends through an arcuate slot 62 in the launch pad 24. Movement of the post 60 toward the front handle end 14 of the launcher 10 causes the ramp portion 54 to be pivoted downwardly allowing the leading top to fall out of the top chamber, and onto the launcher pad. The top 22 is guided downwardly by a guideway comprising guide walls 64 forming a V-shaped slide for the top. As the ramp portion 54 is pivoted downwardly to discharge the leading top, it actuates a lever 66 having a central portion pivotally mounted on the body at 68 and one end 70 extending into a slot 72 in the ramp portion 54. The opposite end of the lever 66 extends into a reciprocally movable stop member 74, urging the stop member upwardly and causing a tapered end 76 thereof to move in front of the top adjacent to the leading top for preventing the remaining tops from rolling into the discharge position.

The launch means comprises an elongated substantially rectangular block 78 projecting laterally outwardly from a side surface of the launcher 10. The block 78 has downwardly slanting surfaces defining a substantially V-shaped channel 80 terminating in an elongated inverted T-shaped slot 82 at the bottom thereof. One of the side edges of the slot is provided with a gear rack 84 extending from a starting launching position on the launch pad to the open end 85 of the slot. At the starting launching position, opposite edges of the slot 82 are provided with notches 86 forming a pair of shoulders 88 for supporting portions of the annular rib 42 when the top slides gear first into the starting launching position. Accordingly, when the top 22 comes to rest at the starting launching position, the top is in a slightly inclined position with the rib 42 resting on the shoulders 88, and the saucer-shaped portion 26 of the enlarged end of the top resting on railings 90 formed by the upper surface of the launch pad.

Launch means are provided on the launch pad for engaging the top and urging the gear 46 thereof along the gear rack 84 for imparting rotation and forward motion to the top, and for expelling the top from the open-end 85 of the slot 82 onto a flat support surface. The launch means comprises a slider 92 having a first substantially rectangular plate member 94 mounted within the T-shaped slot 82 for reciprocal movement upon manual movement of a handle 96 extending upwardly from the slider. The first plate 94 has a U-shaped notch 98, which is adapted upon forward movement of the slider to engage the rounded peg 48 on the top for sliding the top off the shoulders 88, and the gear 46 thereof into meshing engagement with the gear rack 84. As this occurs, the top is moved into a vertical position, and a U-shaped notch 100 in a second substantially rectangular plate 102 parallel to the first plate 94 is moved into engagement with the recess 40 in the top adjacent the rib 42. The slider 92 further has a third substantially rectangular plate 104 having a U-shaped slot 106 for engaging the circular shoulder 38 on the top. By virtue of the three plates, forward movement of the slider 92 by means of the handle 96 causes the gear 46 on the top to roll along the gear rack 84, imparting a rotation or spinning movement to the top, and for expelling the spinning top through the open end 85 of the slot 82 when the slider reaches its outermost position. Stop members, not shown, are provided adjacent each end of the slot for preventing the slider from becoming detached from each end of the launch pad.

When the slider 92 is in the starting launching position on the launch pad 24, a laterally extending C-shaped plate 108 on the slider engages the end of the post 60 extending outwardly through the arcuate slot 62. Accordingly, sliding movement of the slider in a rearward direction toward the handle end 16 of the launcher actuates the top discharge means for releasing a top. The released top free falls into the starting launching position with the rib 42 resting on the shoulders 88 and the saucer-shaped portion 26 of the enlarged end of the top resting on the railings 90. This positions the top in a slightly inclined position, as seen in FIG. 5. Forward movement of the slider 92 toward the rear tail end 18 of the launcher causes the slider plates 94, 102, 104 to impart rotation and forward motion to the top and to expel the top from the open-end of the slot for spinning motion on a flat support surface.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy top launcher for a top, said top having a circular enlarged end, an opposite end, and a gear adjacent the opposite end thereof, said launcher comprising:

a launch pad having a pair of spaced elongated edges defining an open-ended elongated slot;

a gear rack along one edge of the slot;

support means on the launch pad for supporting the top in a substantially vertical starting launching position with the gear in the slot; magazine means for holding one or more tops prior to launching;

loading means for rotating a top from said magazine into the launching position; and launch means on the launch pad for engaging the top and urging the gear thereof along the gear rack for imparting rotation and forward motion to the top and expelling the top from the open-end of the slot.

2. A toy top launcher according to claim 1 wherein the support means supports the top in a position slightly inclined from the vertical.

3. A toy top launcher according to claim 1, wherein said magazine means comprises holding means for holding a plurality of tops in a substantially horizontal orientation in a row in alignment with one another, and discharge means for discharging the leading top onto the top support means of the launch pad.

4. A toy top launcher according to claim 3 wherein the top further has a circular shoulder adjacent the enlarged end thereof, and wherein the holding means comprises launcher body means defining an elongated chamber for receiving the enlarged ends of each top, the body means having an inclined ramp for supporting the circular shoulder on the top, and a stop member for stopping the leading top in a discharge position.

5. A toy top launcher according to claim 4 wherein the discharge means comprises a movable ramp portion of the ramp at the discharge position, which is movable between a normal top holding position and a top releasing position.

6. A toy top launcher according to claim 5 wherein the ramp portion is pivotally movable and has a laterally extending post, wherein the launch means comprises a reciprocally movable slider having a plate engageable with the post for moving the ramp position between its normal top holding and top releasing positions.

7. A toy top launcher according to claim 5, and further comprising guide means defined by the body means for guiding a released top onto the top support means of the launch pad into the starting launching position.

8. A toy top launcher according to claim 2 wherein the top support means comprises a pair of railings engageable by the enlarged end of the top in its starting launching position, and post notches are provided in the edges of the elongated slot defining shoulders for engaging a portion of the top adjacent the gear.

9. A toy top launcher according to claim 8 wherein the portion of the top comprises an annular rib.

10. A toy top launcher according to claim 8 wherein the opposite end of the top comprises a rounded peg, the top further having a circular shoulder adjacent the enlarged end thereof, an annular rib adjacent the gear, and a peripheral recess adjacent the annular rib, and wherein the launch means comprises a slider mounted on the launch pad for reciprocal movement, the slider having a first notched plate for receiving and engaging the rounded peg for moving the slightly inclined top into a vertical position and the gear into toothed engagement with the gear rack.

11. A toy top launcher according to claim 10 wherein the slider further has a second notched plate, spaced from and parallel to the first notched plate, for receiving the peripheral recess on the top and holding the gear thereof into engagement with the gear rack.

12. A toy top launcher according to claim 11 wherein the slider further has a third notched plate spaced from and parallel to the first and second notched plates for receiving the circular shoulder on the top, whereby the first, second and third notched plates engage and propel the top along the longitudinal slot and out of the open-end thereof.

13. A method for launching a rotating top having a circular enlarged end and a gear adjacent the opposite end thereof from a top launcher onto a flat surface for spinning rotation thereon, the launcher having a launch pad provided with a pair of spaced elongated edges defining an open-ended elongated slot, a gear rack along one edge of the slot, support means on the launch pad for supporting a top in a substantially vertical starting launching position with the opposite end of the top and gear in the slot, magazine means for holding one or more tops prior to launching;

loading means for rotating a top from said magazine into the launching position and a reciprocally mounted movable slider on the launch pad having a shoulder engagable with the post for moving the ramp portion between its normal top holding and top releasing positions, the method comprising the steps of:

rotating the top from the magazine to a starting launching position with the top in a substantially vertical position, and the opposite end of the top and gear in the slot;

propelling the top along the slot by means of the slider causing the gear to engage the gear rack and to move therealong for imparting rotation to the top; and expelling the rotating top out of the open-end of the slot onto a flat surface for rotation thereon.

14. A method for launching a rotating top according to claim 13 comprising the further steps of storing a plurality of tops in said magazine;

discharging the tops from said magazine one at a time; and guiding each top discharged from the magazine to the starting launching position.

* * * * *